US006976583B2

(12) United States Patent
Horn

(10) Patent No.: US 6,976,583 B2
(45) Date of Patent: Dec. 20, 2005

(54) TRANSPORTATION AND DISPENSER BOX MADE OF CARDBOARD AND INCLUDING A ROLL OR ITEMS TO BE USED IN GARAGES

(75) Inventor: Joachim Horn, Schwalmstadt (DE)

(73) Assignee: Horn & Bauer GmbH & Co. KG, Schwalmstadt (DE)

( * ) Notice: Subject to any disclaimer, the term of this patent is extended or adjusted under 35 U.S.C. 154(b) by 200 days.

(21) Appl. No.: 10/298,677

(22) Filed: Nov. 18, 2002

(65) Prior Publication Data

US 2004/0016668 A1 Jan. 29, 2004

(30) Foreign Application Priority Data

Jul. 24, 2002 (DE) ..... 102 33 602

(51) Int. Cl.[7] ..... B65D 85/672

(52) U.S. Cl. ..... 206/395; 206/408; 206/409; 242/588.4

(58) Field of Search ..... 206/395, 397, 206/407–409; 242/588.4

(56) References Cited

U.S. PATENT DOCUMENTS

| | | | | |
|---|---|---|---|---|
| 2,936,937 A | | 5/1960 | Guyer | |
| 3,302,781 A | | 2/1967 | Rudnick | |
| 3,317,099 A | | 5/1967 | Solomon | |
| 3,477,624 A | | 11/1969 | Branyon et al. | |
| 3,530,980 A | * | 9/1970 | Link | 206/408 |
| 3,565,307 A | | 2/1971 | Wiley et al. | |
| 3,698,548 A | * | 10/1972 | Stenzel et al. | 242/588.4 |
| 4,274,573 A | | 6/1981 | Finkelstein | |
| 4,773,532 A | * | 9/1988 | Stephenson | 206/390 |
| 5,503,292 A | * | 4/1996 | Cuccharia | 220/908 |
| 5,688,394 A | | 11/1997 | McBride, Jr. et al. | |
| 5,971,150 A | | 10/1999 | Anderson et al. | |
| 6,283,405 B1 | * | 9/2001 | Tracy | 206/395 |
| 6,564,942 B1 | * | 5/2003 | Shiffler et al. | 206/395 |

(Continued)

FOREIGN PATENT DOCUMENTS

DE 69 27 674 U 7/1969

(Continued)

OTHER PUBLICATIONS

Das Cornuflex Compact System brochure, 4 pages, AHB Auto-Teile, Hans Barz, publication date Jan. 1995. (Included in previous IDS but without a date).

(Continued)

*Primary Examiner*—Luan K. Bui
(74) *Attorney, Agent, or Firm*—Thomas, Kayden, Horstemeyer & Risley, LLP

(57) ABSTRACT

A box for supplying items to be used in garages such as seat covers, steering wheel covers, floor carpets, trash bags, replacement parts bags, foils for sealing the interior of doors and bags for tires includes a portion being made of cardboard and including a plurality of side walls and front walls. The portion in its upright position forms the shape of the box. A roll having a width is located in the portion in its upright position. The roll includes a sheet material including items to be used in garages. The items are interconnected by perforations. The sheet material has been wound up on a bobbin having a width, the width of the bobbin being more than the width of the roll. A plurality of supporting elements is located in the box, and it is designed and arranged to support the roll to be rotatable. An opening is located in the portion, and it is designed and arranged to allow for passage of the sheet material out off the box and to remove items from the box.

13 Claims, 1 Drawing Sheet

U.S. PATENT DOCUMENTS

2002/0074375 A1 6/2002 Irwin

FOREIGN PATENT DOCUMENTS

| | | |
|---|---|---|
| DE | G 89 02 641.1 | 6/1989 |
| DE | 89 06 585 U | 7/1989 |
| DE | G 93 10 908.3 | 4/1994 |
| DE | 195 40 115 A | 10/1995 |
| DE | 195 48 336 | 5/1997 |
| DE | 198 19 507 A | 4/1998 |
| DE | 101 19 821 A | 4/2001 |
| FR | 2 681 846 A | 4/1993 |
| GB | 1 518 913 A | 7/1978 |

OTHER PUBLICATIONS

Das Cornuflex Compact System brochure, 4 pages, AHB Auto-Teile, Hans Barz.

European Search Report, Oct. 23, 2003, 4 pages.

* cited by examiner

TRANSPORTATION AND DISPENSER BOX MADE OF CARDBOARD AND INCLUDING A ROLL OR ITEMS TO BE USED IN GARAGES

CROSS REFERENCE TO RELATED APPLICATIONS

This application claims priority to co-pending German Patent Application No. 102 33 602.4 entitled "Transport- und Spenderbox aus einem Zuschnitt aus Karton, Wellpappe o. dgl. und mit der darin untergebrachten und zu einer Rolle aufgewickelten Bahn", filed Jul. 24, 2002.

FIELD OF THE INVENTION

A transportation and dispenser box includes two components, namely a portion made of cardboard, corrugated cardboard and the like and a roll being located in the box. The portion includes a number of walls and flaps being pivotally interconnected by folding lines. The walls and flaps are designed and arranged to be brought in an upright position, and to be fixed in the upright position such that one attains a transportation box serving to protect the enclosed roll during transportation. The sheet material of material forming the roll includes a number of separate items being interconnected by perforations. For example, the items may be seat covers made of plastic foil, one-way floor carpets, steering wheel covers made of foil and the like. The sheet material of material has been wound up on a bush or a bobbin to form the roll. The upright portion of cardboard in addition to bottom walls, side walls and front walls also includes an opening for pulling the elongated sheet material out of the box such that single items may be torn apart by the perforations, and the items may be used as desired.

BACKGROUND OF THE INVENTION

A transportation and dispenser box is known from the leaflet "*Das CORNUFLEX Compact System*", edition 1/1995 of the Applicant. The leaflet shows a portion of cardboard, corrugated cardboard and the like in which a sheet material of material being wound up on a bobbin is placed in an upright box. The upper bottom wall or cover wall is designed as a flap with a closing tongue element, and after having inserted the roll, it may be moved to reach the closed position. An opening is located between the closing flap and the respective vertical side wall, the opening serving for the sheet material passing out off the box. The sheet material is wound up on a bobbin to form a roll, the width of the sheet material being identical to the length of the bobbin. The sheet material being wound up on the bobbin to form a roll is an elastic structure having a respective diameter and respective elastic properties depending on the winding conditions. The square cross-section of the portion of the transportation and dispenser box is chosen such that the roll in the closed position of the upright portion in the region of all bottom walls, side walls and front walls contacts the material of the portion. When the roll has been wound up in a rather loose way, it has sort of a surface contact to the bottom walls and the side walls. Consequently, when pulling the sheet material out off the box, a relatively great resistance has to be overcome. Furthermore, the square cross-section has been designed to be rather small to reduce the cost of the package material. When using the known box, there is the danger of an item already being torn apart at its perforation when the perforation is still located in the interior of the transportation and dispenser box. In such a case, the user may use the item, but the end of the sheet material is still located inside of the box such that there only is the possibility of opening the transportation and dispenser box to reach the end of the sheet material, and to then move the end out off the box. When using rolls including a comparatively great number of items along the sheet material and having a respective increased width, there is a respectively increased weight and respectively increased friction of the roll in the transportation and dispenser box when pulling the sheet material towards the outside. Frictional conditions are also often disadvantageous with respect to the frictional properties existing between the sheet material and the inner side of the transportation and dispenser box such that easy pulling is prevented. It is especially disadvantageous to handle sheet materials being wound up to form a roll in a comparatively soft manner. Consequently, the rolls are elastic, and there is a comparatively great surface of contact to the inner wall of the transportation and dispenser box. This is especially disadvantageous when tearing apart the first item from the sheet material, but it is also relevant when the diameter of the roll has already diminished due to having removed a number of items from the roll. Depending on the relative position of the opening for exiting the path of material from the box in an outward direction with respect to the tangential direction of the path of material on the roll, there may be additional frictional forces to be overcome in the region of the opening.

SUMMARY OF THE INVENTION

The present invention relates to a box for supplying items to be used in garages such as seat covers, steering wheel covers, floor carpets, trash bags, replacement parts bags, foils for sealing the interior of doors and bags for tires includes a portion being made of cardboard and including a plurality of side walls and front walls. The portion in its upright position forms the shape of the box. A roll having a width is located in the portion in its upright position. The roll includes a sheet material including items to be used in garages. The items are interconnected by perforations. The sheet material has been wound up on a bobbin having a width, the width of the bobbin being more than the width of the roll. A plurality of supporting elements is located in the box, and it is designed and arranged to support the roll to be rotatable. An opening is located in the portion, and it is designed and arranged to allow for passage of the sheet material out off the box and to remove items from the box.

The present invention relates to a system for supplying items for protecting parts of automobiles. The system includes a box and a roll element including a core element and sheet material being wound around the core element. The sheet material includes items being interconnected by perforations. A plurality of supporting elements is located in the box, and they are designed and arranged to support the roll element to be rotatable.

The novel box and system securely protects the items contained therein during transportation, and the items may be removed from the box in an easy and reliable way. The present invention is based on the concept of not simply introducing the roll being wound up on a bobbin or a core element into the interior of the upright portion of the box, but to instead support the roll by supporting elements to be rotatable. Such supporting elements reduce friction to an extent such that it is practically impossible to misuse the box. It is not possible to tear apart an item by the perforation when the perforation is still located inside of the box. Instead, it is necessary to move the end of the sheet material out off the box slightly more than the length of the item, to place the sheet material on the edges of the opening to detach the item by the perforation. The free end of the sheet material resulting therefrom remains outside of the transportation and dispenser box, and it is easily accessible and handable for next use. The roll is no longer supported in the transportation and dispenser box on its circumference, but the bobbin is connected to the two supporting elements. For this purpose, the bobbin or the bush is designed to be longer than the width of the sheet material. During removal of an item and during unwinding of the roll, respectively, the bobbin is in sliding contact with the supporting elements. However, friction substantially remains constant. Consequently, this has a positive effect on constancy of resistance during pulling.

The opening for the passage of the sheet material may be designed as a circumferentially closed slot being located in the region of the side wall of the transportation and dispenser box. It is preferred to arrange the opening in the vertical side walls since such an arrangement simplifies handling due to the fact that the portion of the sheet material protruding out off the circumferentially closed slot is supported in the region of the slot, and it is deflected by approximately 90°. In this way, certain friction in the region of the slot is used, the friction being useful when tearing apart and separating, respectively, the perforation to remove and item. However, it is also possible to arrange the slot at a different place, for example in the upper bottom wall.

The circumferentially closed slot for the passage of the sheet material towards the outside may be covered by a removable perforation strip element in the transportation position of the box. In this way, one attains full protection during transportation. After removal of the perforation strip element, the circumferentially closed slot may be accessed, and the transportation box becomes a dispenser box. Then, it is only necessary to pull the beginning of the sheet material through the slot in an outward direction.

There is a number of different possibilities of arranging the circumferentially closed slot. For example, the circumferentially closed slot may be arranged approximately at half the height of the lower half or of the upper half of a vertical side wall. In association with this arrangement, the roll is suspended with a lower removal portion or an upper removal portion such that the pulling forces acting upon the roll are directed in an approximately tangential direction without substantial deflections. The arrangement of the circumferentially closed slot in a vertical side wall provides for the advantage of limiting the danger of dust entering the interior of the dispenser box through the circumferentially closed slot.

The relative design and arrangement of the roll with respect to the interior of the transportation and dispenser box may be chosen such that the roll is suspended at the supporting elements to be freely rotatable. The size of the square cross-section of the interior of the box is slightly more than the outer diameter of the roll. In this way, the roll does not contact the inner walls of the box. However, it is also possible to choose a different design such that the roll first contacts the inner side walls of the box, but does no longer contact the inner side walls of the box after having removed some of the items from the roll of items.

There is a number of different possibilities of designing the supporting elements or supports. For example, the supporting elements for rotatably suspending the roll may be designed as inserting flaps being connected to the front walls and including an opening. In this way, there is some sort of a double layer in the region of the front walls. The openings forming the supporting elements are only located at the inserting flaps such that the transportation and dispenser box is closed as seen from the outside. Additionally, the front walls being connected to the inserting flaps in an outward direction function as stops providing for a centered arrangement of the bobbin of the roll.

In a simplified exemplary embodiment, the supporting elements for rotatably suspending the roll may be designed as openings being located approximately in the center of the front walls. In this way, it is possible to design the transportation and dispenser box to be slightly shorter since the material of the portion may be less.

It is also possible that plate-like supporting walls including openings are inserted into the upright portion to function as the supporting elements for rotatable suspension of the roll. Such an arrangement combines the advantages of a small size of the portion and the centering effect in the box.

The two surfaces of the sheet material or path of material may have different roughness. In such a case, the sheet material is wound up on the bobbin such that the smoother surface of the sheet material faces towards the outside. This arrangement has the effect of friction is reduced even when beginning to use the box and when the outer circumference of the roll contacts the side walls. After some items have been removed and the diameter of the roll has diminished, there will be no contact to the inner sides of the side walls, anyway. On the other hand, in combination with an upper removal, there is the advantage that it is possible to use the comparatively rougher surface of the sheet material in the region of the circumferentially closed slot to simplify removal of an item.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
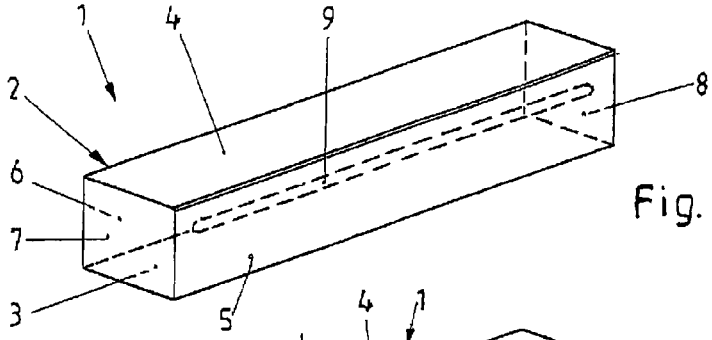
FIG. 1 is a perspective view of the novel transportation and dispenser box in the transportation condition.

Referring now in greater detail to the drawings, FIG. 1 illustrates a transportation and dispenser box 1 being made of a portion 2 of cardboard. The cardboard may be carton, corrugated cardboard and the like. The transportation and dispenser box 1 includes a lower bottom wall 3, and upper bottom wall 4, a front vertical side wall 5, a rear vertical side wall 6 and two front walls 7 and 8. A perforated strip 9 is arranged in the upper half of the vertical front side wall 5, the perforated strip 9 being designed and arranged to be removed from the box 1 such that a slot 10 is formed, as illustrated in FIG. 2.

Figure 2:
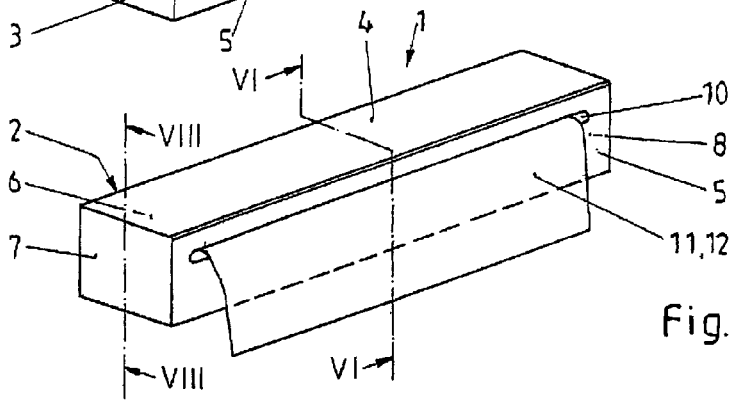
FIG. 2 is a view of the novel transportation and dispenser box in the position when being used.

FIG. 2 illustrates the box 1 in its position ready to be used. The end of an elongated path of material or a sheet material 11 being formed by a plurality of items 12 being interconnected by perforations protrude out of the box 1. For example, these items 12 may be seat covers made of plastic foil as they are used to protect the seats of an automobile during repairing and servicing the automobile in a garage to prevent soiling of the seats. These seat covers and the sheet material 11, respectively, have a certain width of approximately between 60 cm and 1 m.

Figure 3:
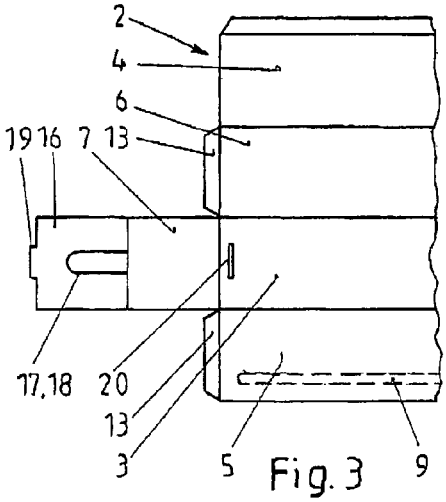
FIG. 3 is a semi-sectional view of the unfolded portion of which a first exemplary embodiment of the novel transportation and dispenser box is to be formed.

FIG. 3 explains the design of the portion 2 for forming the transportation and dispenser box 1 according to FIGS. 1 and 2 by the portion 2 being shown unfolded to be located in one plane. It is to be seen that the side walls 5 and 6 are connected to the lower bottom wall 3 by fold lines. The side walls 5 and 6 include lateral connection flaps 13 and 14 to be connected with the associated elements of the portion 2 in the upright position. The upper bottom wall 4 is connected to the side wall 6 by another fold line. The upper bottom wall 4 is connected to the closing flap 15 by a fold line such that the closing flap 15 is pivotable.

Since the walls 3, 4, 5, 6 have the same height, it is imaginable that there is a square cross-section in the upright position of the box 1. Front walls 7 and 8 are connected to both sides of the lower bottom wall 3 by fold lines. A supporting wall 16 is connected to each front wall 7 and 8 by another fold line. A portion 17 is located in the supporting wall 16, the portion 17 forming a support 18. Additionally, the supporting wall 16 in its outer region includes a protrusion 19. The lower bottom wall 3 includes a punched out element 20 being associated with the protrusion 19 and being engaged by the protrusion 19 in the upright position such that the front wall 7 and the supporting wall 16 are fixed in a parallel position at the end of the transportation and dispenser box, as this is illustrated in FIG. 8.

Figure 6:
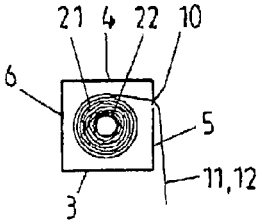
FIG. 6 is a sectional view along line VI—VI in FIG. 2 with an upper outlet.
Figure 8:
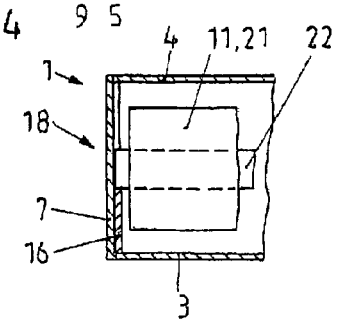
FIG. 8 is a sectional view along line VIII—VIII in FIG. 2.

It is to be seen from FIGS. 6 and 8 that the sheet material 11 is located in the interior of the transportation and dispenser box 1. The sheet material 11 is wound up to form a roll 21 being located on a bush or bobbin 22. It is to be seen from FIG. 8 that the bobbin 22 has a width being more than the width of the sheet material 11 and the roll 21 such that the bobbin 22 protrudes with respect to the roll 21 at both sides. Consequently, the roll 21 may be freely suspended on the bobbin 22 at both sides being supported at supports 18. FIGS. 2, 6 and 8 illustrate the roll 21 being supported by the supports 18 to be suspended to be freely rotatable. The roll 21 does not contact the inner side of the bottom walls 3 and 4 and the side walls 5 and 6. Since the front walls 7 and 8 in combination with the supporting walls 16 also have a centering effect with respect to the bobbin 22, it is ensured that there is no frictional contact of the supporting walls 16 to the material of the sheet material 11 and of the roll 21, respectively. Thus, the roll 21 may be easily rotated when pulling the front end of the sheet material 11 through the slot 10. FIGS. 2 and 6 illustrate the roll 21 being supported in this way in the transportation and dispenser box 1 and exiting the box 1 in an upper region. The perforation strip element 9 and the slot 10 are located in the middle portion of the upper half of the front side wall 5. It may be seen from FIG. 6 that the sheet material 11 is pulled out of the box 1 in an approximately tangential direction such that the end of the sheet material 11 exiting the box 1 through the slot 10 is directed by approximately 90°. When the sheet material 11 has a design such that it has a comparatively smooth outer surface and a comparatively rough inner surface, the rough surface is used in an advantageous way when contacting the lower edge of the slot 10 during separation of the perforated portions during removal of an item 12 from the elongated sheet material 11.

The above described way of suspending the bobbin 22 to be freely rotatable in the supporting elements 18 is not only realized when a few items 12 have been removed from the sheet material 11. The bobbin 22 may already be freely rotatable when a complete roll 21 is inserted into such a transportation and dispenser box 1, and during transportation of the box 1. However, it is not disadvantageous to chose the size of the diameter of the roll 21 and the size of the square interior of the transportation and dispenser box 1 such that the roll 21 being elastic in a certain way initially contacts the inner walls of the box 1. However, there is no contact after having removed a few items 12 resulting in a reduction of the diameter of the roll 21. Such rolls 21 may include up to approximately 500 or more items 12 being interconnected by perforations. The number of items 12 depends on the wall thickness and potential longitudinal folds of the items 12 and from the size of the box 1.

Figure 7:
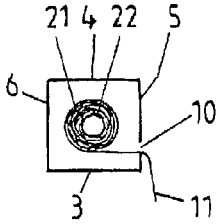
FIG. 7 is a similar view as FIG. 6, but showing a lower outlet.

FIG. 7 illustrates the roll 21 being located in the transportation and dispenser box 1 in an opposite direction compared to FIG. 6, meaning a design in which the items 12 are removed in the lower region of the box 1. The slot 10 is located in the lower portion of half of the height of the side wall 5 to allow for tangential removal in combination with a deflection of the sheet material 11 by approximately 90° when exiting the box 1 through the slot 10.

Figure 4:
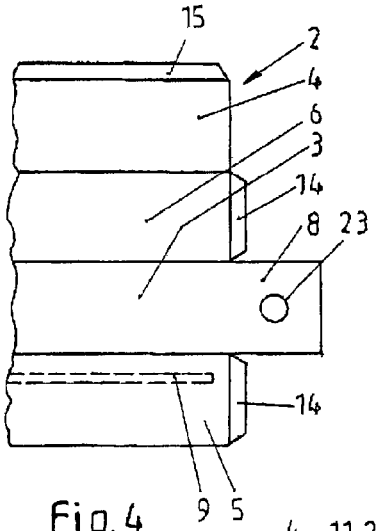
FIG. 4 is a semi-sectional view of the unfolded portion of which a second exemplary embodiment of the novel transportation and dispenser box is to be formed.

The supporting elements 18 may not only be realized by a separate supporting wall 16, as this is illustrated in FIG. 3. FIG. 4 illustrates another exemplary embodiment of the novel box 1 in which there are no supporting walls 16 and in which circular openings 23 are located in the front walls 7 and 8. In this especially simple exemplary embodiment of the novel box 1, the ends of the bobbin, bush or tube 22 protrude through the front walls 7 and 8 of the box 1 to a certain extent.

Figure 5:
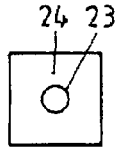
FIG. 5 is a view of a separate supporting wall having a plate-like design to be inserted into the box.

FIG. 5 illustrates a single plate-like supporting wall 24. For example, the supporting wall 24 is designed as a square section of corrugated cardboard box including the opening 23 being located in the center region such that one supporting wall 24 is pushed upon the ends of each bush 22 during insertion of the roll 21. The unit resulting therefrom is inserted into the upright transportation and dispenser box in a downward direction. It is to be understood that the front walls 7 and 8 do not include openings 23 when being used in combination with the supporting walls 24 when it is desired to realize the above described centering effect. However, it is also possible to arrange additional openings 23 in the front walls 7 and 8 to enlarge the width of the respective support of the bobbin 22 in the lateral supporting elements 18. The use of such separate supporting walls 24 which may also be fixed in the upright portion 2 provides for the advantage of the portion 2 not necessarily being made of double corrugated cardboard box. Instead, single corrugated cardboard box is sufficient since additional stiffening effects are attained due to the inserted supporting walls 24. The supporting walls 24 may also include an opening having a shape as it is to be seen from FIG. 3.

Many variations and modifications may be made to the preferred embodiments of the invention without departing substantially from the spirit and principles of the invention. All such modifications and variations are intended to be included herein within the scope of the present invention, as defined by the following claims.

I claim:

1. A box for supplying items to be used in garages, comprising:

said box being made of cardboard formed in a rectangular shape with opposed top and bottom walls, opposed side walls and opposed end walls, a length of sheet material formed in a spiral reel having a free end extending from said reel and being located in said box, said sheet material including items interconnected by perforations, a bobbin having ends, said sheet material spirally wound about said bobbin to form said reel with the ends of the bobbin protruding from the reel and the bobbin being rotatable with the reel in response to the sheet material being paid out from the reel, supporting elements being located in said box at said end walls and being designed and arranged to rotatably support said ends of the bobbin with the reel rotatable in the box without the reel engaging the bottom wall of the box, an opening being located in a side wall of said box designed and arranged to allow for passage of the free end of said sheet material out of said box and to remove items from said box, wherein at least one of said supporting elements is built with a supporting wall including an opening, the opening extending from the upper end of the supporting wall to the middle of the supporting wall with a width of at least the outer diameter of said bobbin, said bobbin is directly supported by said supporting elements, said bobbin being freely rotatable with respect to said supporting elements, and said sheet material has two surfaces of different roughness, said sheet material being wound up on said bobbin to form said reel in a way that the surface having less roughness faces toward the outside of said reel.

2. The box of claim 1, wherein said opening is located in the region of one of said side walls, said opening being designed as a circumferentially closed slot.

3. The box of claim 2, wherein said circumferentially closed slot is covered by a removable perforation strip element.

4. The box of claim 2, wherein said side walls have a height, an upper portion and a lower portion, said side walls being arranged to be vertical, said circumferentially closed slot being ranged approximately at half the height of the upper portion of one of said side walls.

5. The box of claim 3, wherein said side walls have a height, an upper portion and a lower portion, said side wall being arranged to be vertical, said circumferentially closed slot being arranged approximately at half the height of the upper portion of one of said side walls.

6. The box of claim 2, wherein said side walls have a height, an upper portion and a lower portion, said side wall being arranged to be vertical, said circumferentially closed slot being arranged approximately at half the height of the lower portion of one of said side walls.

7. The box of claim 3, wherein said side walls have a height, an upper portion and a lower portion, said side wall being arranged to be vertical, said circumferentially closed slot being arranged approximately at half the height of the lower portion of one of said side walls.

8. The box of claim 1, wherein said supporting elements are designed as folding flap elements each being connected to one of said end walls, said folding flap elements each including an opening being designed and arranged to contact and support said reel to be rotatable.

9. The box of claim 1, wherein supporting elements are designed as openings each being located in the center of one of said end walls, said openings being designed and arranged to contact and support said reel to be rotatable.

10. The box of claim 1, wherein said supporting elements are designed as supporting walls, said supporting walls having a plate-like shape and including openings being designed and arranged to contact and support said reel to be rotatable, said supporting walls being designed and arranged to be insertable into said box in its upright position.

11. The box of claim 1, wherein said reel is located in said box to remove said items from said box in an upper region of said box.

12. The box of claim 1, wherein said items are made of plastic foil and taken from the group consisting of seat covers, steering wheel covers, floor carpets, trash bags, replacement parts bags, foils for sealing the interior or doors and bags for tires.

13. A box and a length of sheet material formed in a spiral reel in said box for supplying items from the reel, comprising:

said box formed of a single sheet of cardboard and including opposed top walls, opposed side walls, and opposed end walls and formed in a rectangular shape and defining a rectangular compartment for receiving said reel, one of said side walls defining an opening shaped and arranged to allow for passage of the sheet material out of said box, a bobbin, said sheet material spirally wound directly onto said bobbin to form the reel about the bobbin and having opposed surfaces of different roughness, with one surface being more rough than the other surface, and said sheet material having a free end extending from said reel for being withdrawn through said opening, said sheet material formed of a series of items interconnected by perforations at intervals along the length of said sheet material such that the items can be paid out from the reel one at a time and separated from the items on the reel at the perforations, said bobbin being rotatable with said reel in response to the free end of the sheet material being withdrawn from said reel, said bobbin having ends that protrude from the is opposite ends of said reel, a bobbin support formed in each of said end walls of said box of a breadth sufficient to receive the ends of said bobbin and at a height in said end walls to support said reel away from said bottom wall of said box and to allow the reel and the bobbin to rotate within said compartment in response to the free end of the sheet material being pulled from the reel and through the opening, said bobbin being rotatable with said reel in said bobbin support in response to the free end of the sheet material being withdrawn from the reel and passed through the opening of the box, and said surface of said sheet material having less roughness faces the toward the outside of said reel, such that if the outside of the reel engages the box the friction between the reel of sheet material and the box is minimized.

* * * * *

UNITED STATES PATENT AND TRADEMARK OFFICE

CERTIFICATE OF CORRECTION

PATENT NO. : 6,976,583 B2
DATED : December 20, 2005
INVENTOR(S) : Joachim Horn

It is certified that error appears in the above-identified patent and that said Letters Patent is hereby corrected as shown below:

Title page,
Item [54], Title, should read -- TRANSPORTATION AND DISPENSER BOX MADE OF CARDBOARD AND INCLUDING A ROLL OF ITEMS TO BE USED IN GARAGES --.

Signed and Sealed this

Seventh Day of March, 2006

JON W. DUDAS
*Director of the United States Patent and Trademark Office*